United States Patent [19]

Auersbacher

[11] 4,310,007

[45] Jan. 12, 1982

[54] SELF IGNITING CIGARETTE

[76] Inventor: Imre Auersbacher, P.O. Box 43601, Tucson, Ariz. 85733

[21] Appl. No.: 143,643

[22] Filed: Apr. 25, 1980

[51] Int. Cl.[3] ..... A24F 15/10

[52] U.S. Cl. ..... 131/329; 131/185

[58] Field of Search ..... 131/170 R, 7, 185, 329, 131/351; 431/268, 254, 258; 206/242; D27/364

[56] References Cited

U.S. PATENT DOCUMENTS

| | | | |
|---|---|---|---|
| 1,529,181 | 3/1925 | Holmes | 131/7 |
| 1,835,928 | 12/1931 | Boillot | 131/7 |
| 3,046,995 | 7/1962 | Christy | 131/7 |
| 3,136,318 | 6/1964 | Nakamura | 131/7 |
| 3,359,987 | 12/1967 | Ishi | 131/7 |

FOREIGN PATENT DOCUMENTS

| | | | |
|---|---|---|---|
| 2726290 | 1/1979 | Fed. Rep. of Germany | 131/7 |
| 2726960 | 1/1979 | Fed. Rep. of Germany | 131/329 |
| 2006607 | 5/1979 | United Kingdom | 131/329 |

*Primary Examiner*—V. Millin

*Attorney, Agent, or Firm*—Richard L. Miller

[57] ABSTRACT

A cigarette and a pack in which it is retailed, the cigarette, in one design of the invention, including an oxidizing and reducing agent on its end adjacent a layer of potassium nitrate treated tobacco, so that the cigarette end is contacted against a catalyst on a foil disc mounted on a side of the pack so as to ignite the cigarette without use of a match or lighter; and which, in another design of the invention includes an alkaline battery housed in the pack and whose terminals are contacted by a film of low resistance carbon fibers on the cigarette end.

5 Claims, 4 Drawing Figures

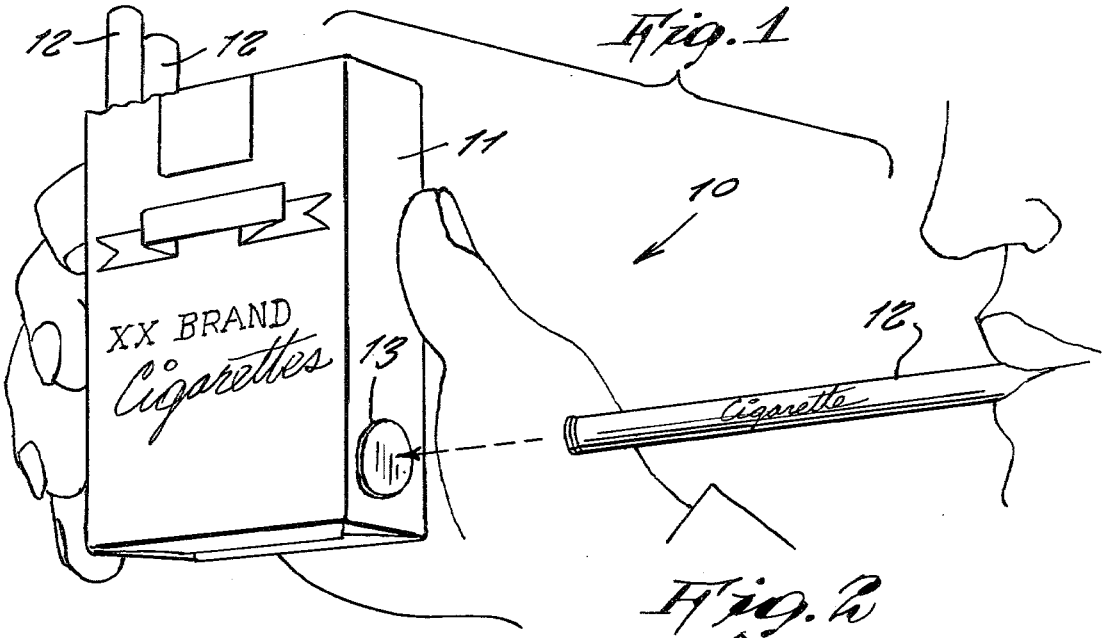
Fig. 1
12
12
11
10
XX BRAND
Cigarettes
13
12
Cigarette
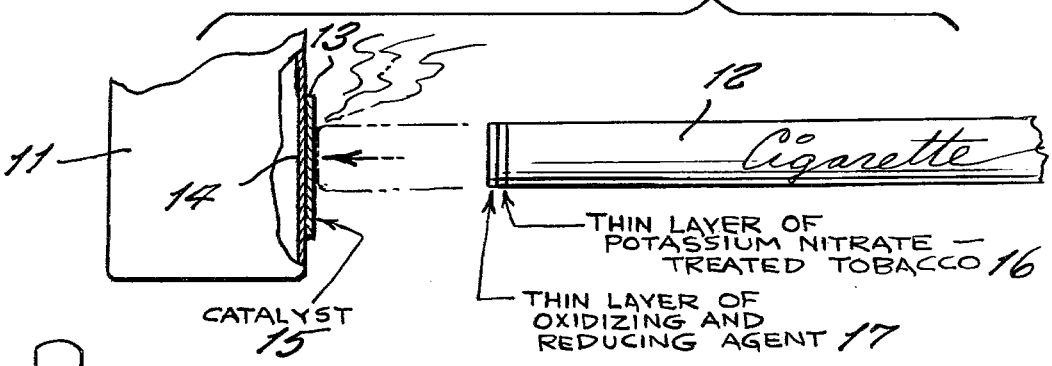
Fig. 2
13
12
11
14
Cigarette
THIN LAYER OF POTASSIUM NITRATE — TREATED TOBACCO 16
CATALYST 15
THIN LAYER OF OXIDIZING AND REDUCING AGENT 17
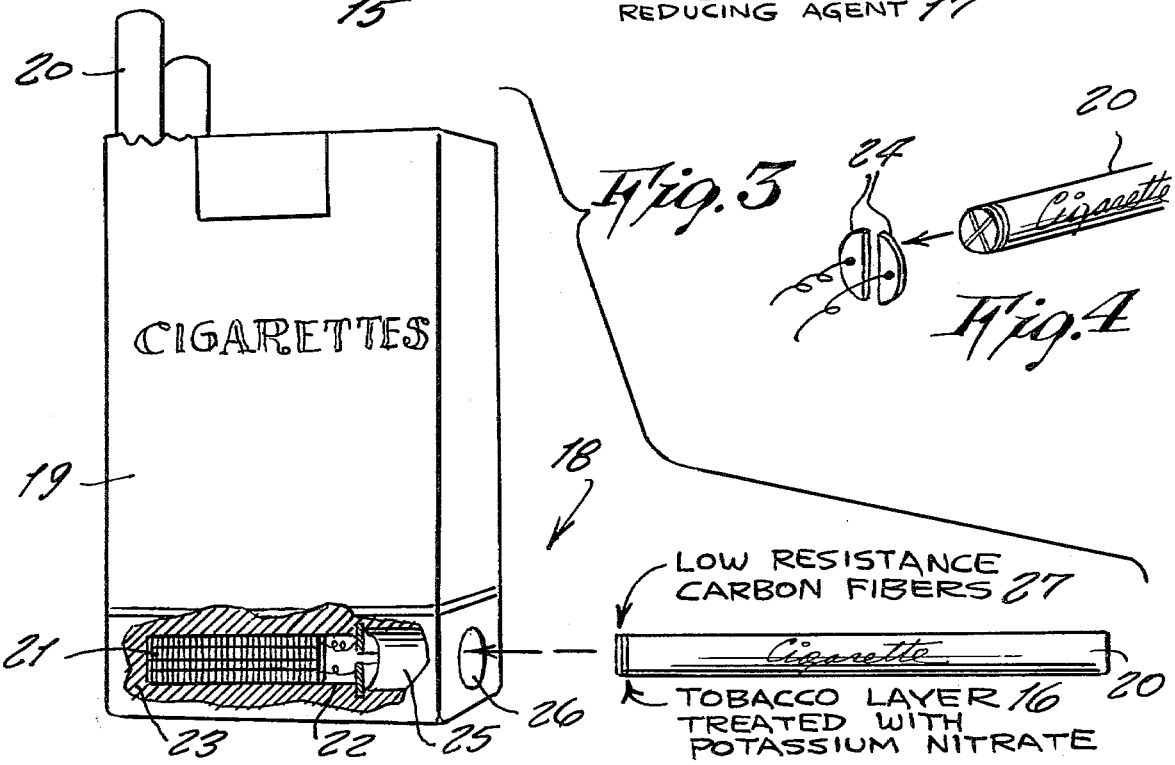
20
CIGARETTES
19
18
21
23
22
25
26
Fig. 3
24
20
Cigarette
Fig. 4
LOW RESISTANCE CARBON FIBERS 27
Cigarette
20
TOBACCO LAYER 16 TREATED WITH POTASSIUM NITRATE

SELF IGNITING CIGARETTE

BACKGROUND OF THE INVENTION

This invention relates generally to cigarette igniting means.

It is well known that the conventional manner of igniting a cigarette is by applying a flame either from a match or a butane cigarette lighter to the cigarette end. When there is a strong wind blowing, the flame is often blown out before the ignition is accomplished, also the use of an open flame can be dangerous in causing a fire if done in certain places, so that this situation is therefore in want of an improvement.

SUMMARY OF THE INVENTION

Accordingly it is a principal object of the present invention to provide a new ignition means for a cigarette, and which is matchless and flameless.

Another object is to provide a cigarette ignition means which accordingly does not necessitate extra paraphenelia such as matches or a lighter, and which oftentimes may not be at hand when wanted; so that with the present invention, the smoker needs only a pack of cigarettes from which he removes a cigarette for being smoked.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows:

FIG. 1 is a perspective view of one design of the invention wherein a catalyst disc on the pack is engaged by an oxidizing and reducing agent on the cigarette end.

FIG. 2 is an enlarged diagram thereof.

FIG. 3 is a view of another design of the invention wherein a battery pack at the bottom of the cigarette pack provides an electric method for igniting the cigarette.

FIG. 4 is a detail thereof.

DETAILED DESCRIPTION OF PREFERRED EMBODIMENT

Referring now to the drawing in greater detail, and more particularly to FIGS. 1 and 2 thereof, at this time, the reference numeral 10 represents a Self Igniting Cigarette means according to the present invention wherein there is a cigarette pack 11 containing cigarettes 12.

The pack is of conventional type, comprised of paper, foil and cellophane sheets wrapped around the usual quantity of twenty cigarettes, so that the pack is of a size which conveniently fits in a person's pocket or purse in order to be always readily available whenever a person wishes to procure a cigarette for smoking. In the present invention, the pack includes a metal foil disc 13 mounted on an outer side of the pack by means of a pressure sensitive adhesive 14 on a rear side of the disc. A catalyst 15 is coated on a front side of the disc.

The cigarette includes the usual tobacco rolled up in a thin paper. A filter may or may not be included at its one end. In the present invention, the opposite end of the cigarette has a thin layer of potassium nitrate-treated tobacco 16, and which has a thin layer of oxidizing and reducing agent 17 on its outer side.

In use, the cigarette is ignited upon only a contact of the cigarette agent 17 with the catalyst 15, and which react therewith so as to produce the ignition. By drawing on the cigarette during this engagement, ignition occurs.

In another design of the invention, the same achievement is made as in the design 10, except that it is made by electric means 18, shown in FIGS. 3 and 4. It includes a pack 19 of cigarettes 20, wherein a flat alkaline battery pack 21 is installed within an inward end of a well 22 formed in a thermo-plastic housing 23 at a bottom of a cigarette pack 19. The two terminals of the battery pack are connected to two semi-circular metal contacts 24 that are seated within an inward end of a cavity 25 into which a cigarette can enter through an opening 26 on a side of the pack 19.

The cigarette 20 is similar to the above-described cigarette 12 except that a tobacco layer 16 treated with potassium nitrate is here coated on its outer side with a layer of low resistance carbon fibers 27.

In use, the cigarette 20 is ignited by insertion into the cavity so that the carbon fibers 27 engage the recessed electrode contacts 24.

It is to be noted that the battery pack is provided with only enough charge in order to produce twenty ignitions, for the number of cigarettes contained in the pack 19. Upon engagement with contacts 24, the carbon fibers 27 will glow red hot by a smoker drawing on the cigarette at a same time, so to achieve the ignition.

In both forms of the invention, the tobacco layer treated with the potassium nitrate will initiate a good burn.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A self-igniting cigarette device in combination with a cigarette package, said cigarette package having a hollow interior in which is contained at least one cigarette, and a well at the bottom of said package, said well having a first end remote from a first side edge of said cigarette package, and a second end spaced from said first end, and a cavity also formed in said cigarette package at the bottom thereof, said cavity having a first end adjacent to said second end of said well to provide a continuous opening therebetween, and a second end remote from said first end in a direction away from said second end of said well, said second end of said cavity being formed in a second side edge of said cigarette package so that access to the interior of said well and cavity is possible from outside thereof; a battery mounted in said well, said battery having a first terminal and a second terminal; a first metal contact and a second metal contact, each being mounted in said cavity adjacent said first end of said cavity, said first and second terminals of said battery being in contact with said first and second metal contacts to provide an electric lighting element; and said at least one cigarette having an end thereof comprising an ignitable material, whereby when said end of said cigarette is placed against said first and second metal contacts by insertion through said second end of said cavity, said end will be ignited.

2. The self-igniting cigarette device according to claim 1, wherein each of said first and second metal contacts is hemispherical in shape, said metal contacts being mounted diammetrically opposite to each other at said first end of said cavity.

3. The self-igniting cigarette device according to claim 2, wherein said cavity is circular in cross-section.

4. The self-igniting cigarette device according to claim 3, wherein said end of said at least one cigarette comprises a first layer of potassium nitrate, and a second outer layer of low resistance carbon fibers.

5. The self-igniting cigarette device according to claim 4, wherein said second end of said cavity has a diameter larger than the diameter of said at least one cigarette.

* * * * *